United States Patent [19]

Beeckmans et al.

[11] 4,274,947

[45] Jun. 23, 1981

[54] ELECTROSTATIC METHOD AND APPARATUS FOR SORTING FLUIDIZED PARTICULATE MATERIAL

[76] Inventors: Jan M. Beeckmans, 856 Wellington St., London, Ontario, Canada, N6A 3S7; Ion I. Inculet, 81 Lloyd Manor Crescent, London, Ontario, Canada, N6H 3Z4

[21] Appl. No.: 112,084

[22] Filed: Jan. 14, 1980

[51] Int. Cl.[3] ..... B03C 7/04

[52] U.S. Cl. ..... 209/12; 209/131; 209/474

[58] Field of Search ..... 209/12, 127 R, 127 B, 209/128, 131, 474–476

[56] References Cited

U.S. PATENT DOCUMENTS

| | | | |
|---|---|---|---|
| 1,944,643 | 1/1934 | Holmes et al. | 209/474 |
| 2,116,613 | 5/1938 | Bedford | 209/131 |
| 2,310,894 | 2/1943 | Brusset | 209/422 |
| 3,401,795 | 9/1968 | Tauveron | 209/127 R X |
| 3,402,814 | 9/1968 | Morel et al. | 209/127 |
| 3,407,930 | 10/1968 | Morel et al. | 209/11 |
| 4,194,971 | 3/1980 | Beeckmans | 209/467 |

*Primary Examiner*—William A. Cuchlinski, Jr.
*Attorney, Agent, or Firm*—Fleit & Jacobson

[57] ABSTRACT

A multi-constituent mixture of particles is fluidized within an elongated container with a gas permeable base. Opposing horizontal motions are induced in the upper and lower strata of the fluidized material by means of moving baffles mounted on endless chains within the confines of the container. A potential difference established between a horizontal electrode located in the upper part of the container above most of the bed surface, and the base of the bed induces electrostatic forces on the tribo-electrified particles, thereby affecting the distribution of the vertical composition of the mixture in the bed.

The combination of the opposing horizontal motions and vertical segregation results in a horizontal concentration gradient. The particles thus separated are removed from the ends of the bed by, for example, flowing over weirs.

12 Claims, 3 Drawing Figures

ELECTROSTATIC METHOD AND APPARATUS FOR SORTING FLUIDIZED PARTICULATE MATERIAL

Figure 1:
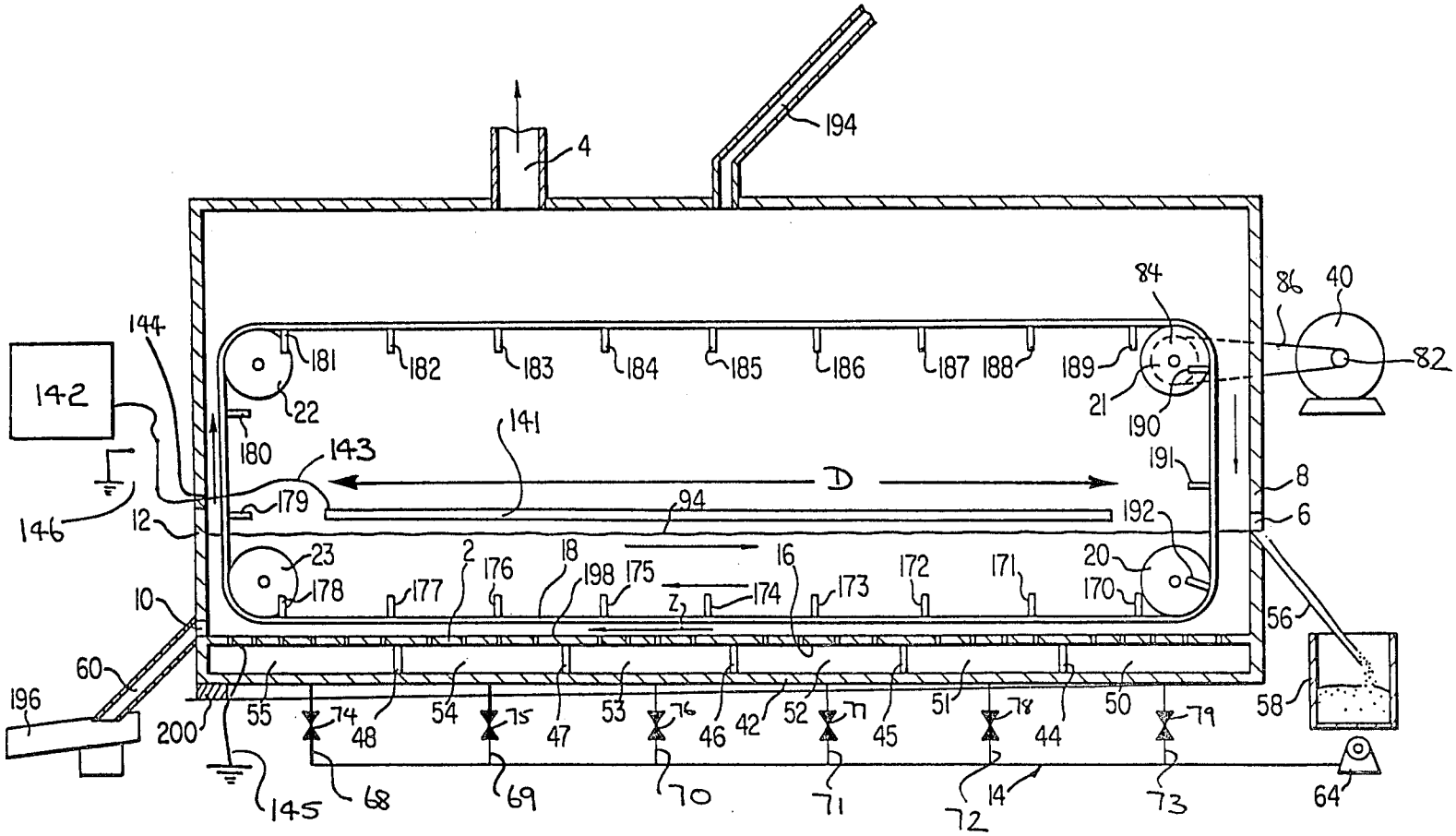

This invention relates to a method of sorting particulate material and apparatus therefore.

It has previously been proposed to separate particulate material by fluidizing a bed of the material. Such processes have been limited to use with materials of differing densities. Attempts have also been made to separate materials of similar density by applying an electrostatic field across the bed.

In one such method, as shown in U.S. Pat. No. 2,116,613, a mixture composed of conducting and non-conducting particles, or of particles of differing conductivities, is fed into the bed through a conducting chute electrified to a high potential, whereby a charge is acquired by the more conducting particles. The charged particles are then attracted by an oppositely charged electrode located beneath a dielectric at the base of the bed. This arrangement has several disadvantages, notably that it is required that at least one component of the mixture to be separated be conductive, that it is susceptible to depolarization through the permanent attachment along the bottom of the container of a layer of charged particles of opposite sign to the electrode, and that the charge distribution on the particles as fed into the bed will have a tendency to alter with time due to contact charging (triboelectrification) by particle-particle or particle-wall collisions, thereby adversely affecting operation of the separator.

A further problem associated with the prior art has been the removal of material from the bed.

One proposal to overcome this disadvantage is shown in the U.S. Pat. No. 3,407,930. In this arrangement the particulate material acquires a tribo-electric charge by virtue of its agitation in the fluidized bed. An electrostatic field is applied across the bed and one of the electrodes is constituted by a moving belt. Particulate material of opposite charge is attracted to the belt and removed from the belt outside the periphery of the bed.

Such an arrangement requires a relatively large electric field, or is applicable to the separation of relatively small particles only, since the electrostatic forces must be sufficiently large as to cause the particles to be physically extracted from the fluidized bed.

It is therefore one object of the invention to provide a method of separation which may be used with non-conducting materials, as well as with mixtures of conducting and non-conducting materials, of similar or dissimilar densities, and in size ranges which are not restricted by the ability of the electrostatic field to lift the particles outside the fluidized bed.

According to the present invention there is provided a method of sorting fluidized particulate material which comprises:

(a) feeding particulate material to an elongated, horizontally extending container having a gas permeable base and at least a major, intermediate lengthwise extending portion of the interior thereof unobstructed by the container for the flow of particulate material towards both a first end and a second end thereof for fluidized material above the gas permeable base, (b) fluidizing a bed of the particulate material in the container, and thereby tribo-electrically charging particles in said bed, (c) generating an electrostatic field across said bed between a pair of vertically spaced electrodes to attract in the upper strata of the bed particles whose tribo charges are opposite in polarity to the upper of said electrodes, and cause an enrichment of such particles in an upper portion of the bed.

(d) generating a recirculatory motion of particles in said bed so that an upper portion of the fluidized bed is moved towards a first end while a lower portion of the fluidized bed is moved towards a second end thereby causing a progressing enrichment of the fluidized bed in particles which are tribocharged to a polarity opposite to the polarity of said electrode towards the fist end with reflux of particles therefrom, and a progressive enrichment of the fluidized bed in particles of opposite polarity towards the second end, with reflux of particles therefrom.

(e) removing particulate material from the first end, and (f) removing particulate material from the second end.

Further, according to the present invention there is provided a fluidized particulate material sorting apparatus, comprising:

(a) a particulate material fluidizing container which is elongated in a horizontal direction and has a base which is gas permeable over substantially the whole area for fluidized particulate material above the gas permeable base, at least a major, intermediate lengthwise extending portion of the interior being unobstructed by the container for the flow of fluidized particulate material therealong, the container having an upper gas outlet.

(b) means for feeding particulate material to the container, (c) means for removing particulate material from a first end of the container, (d) means for removing particulate material from a second end of the container, opposite said first end, (e) means for feeding pressurized gas to substantially the whole area of the underside of the base, (f) drive means within said container and operable to generate a recirculatory motion of particles in said bed so that an upper portion of the fluidized bed is moved toward said first end while a lower portion of the fluidized bed is moved toward said second end.

(g) a pair of spaced electrodes, lying generally parallel to said base and connectible to means to generate a potential difference across said electrodes, whereby in operation, the recirculatory motion of particulate material and the potential difference across said electrodes causes a progressive enrichment of the fluidized bed in particles which are tribocharged to one polarity towards the first end, with reflux of particles therefrom, and a progressive enrichment of the fluidized bed in particles of opposite polarity towards the second end, with reflux of particles therefrom.

Figure 2:
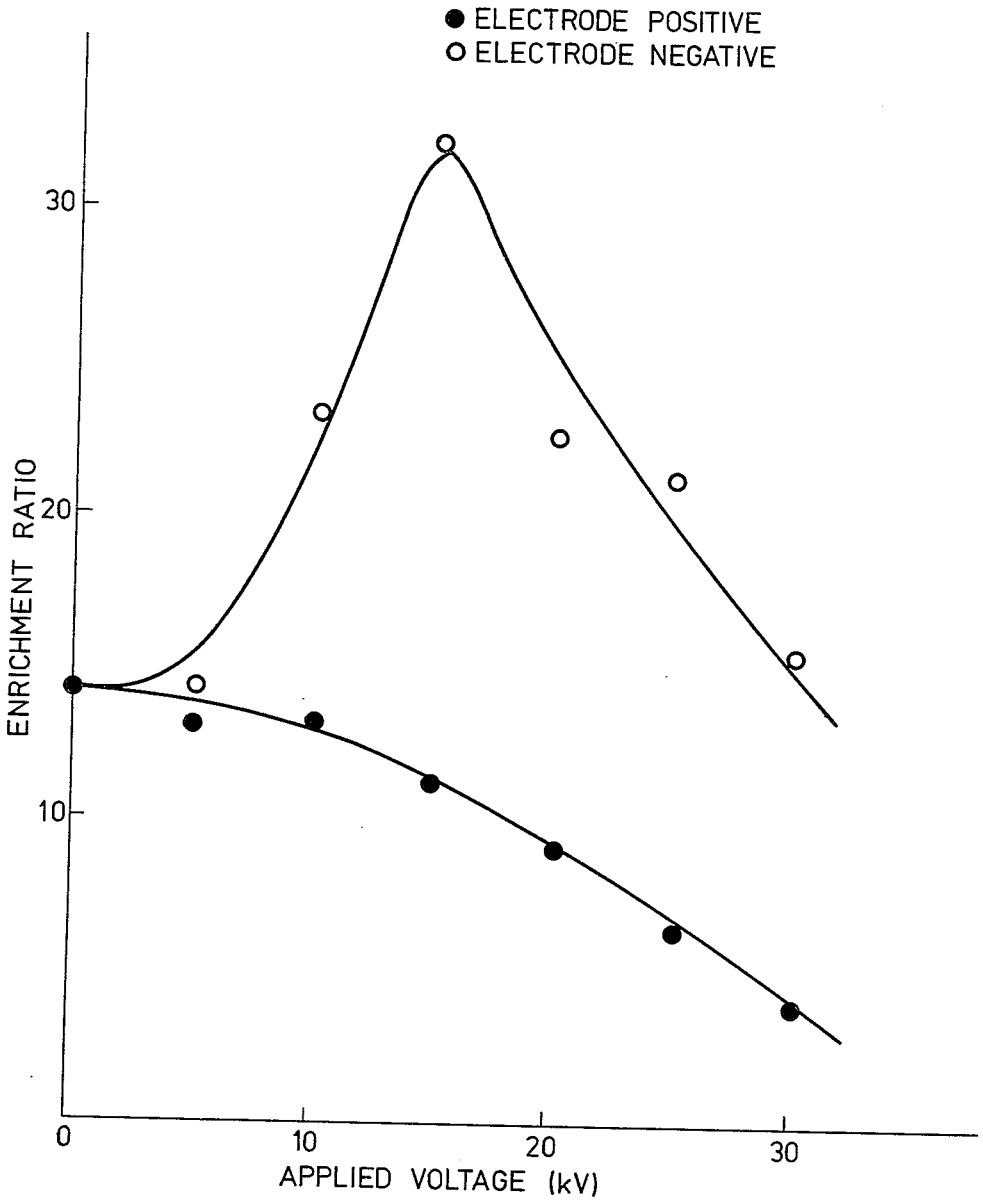
Figure 3:
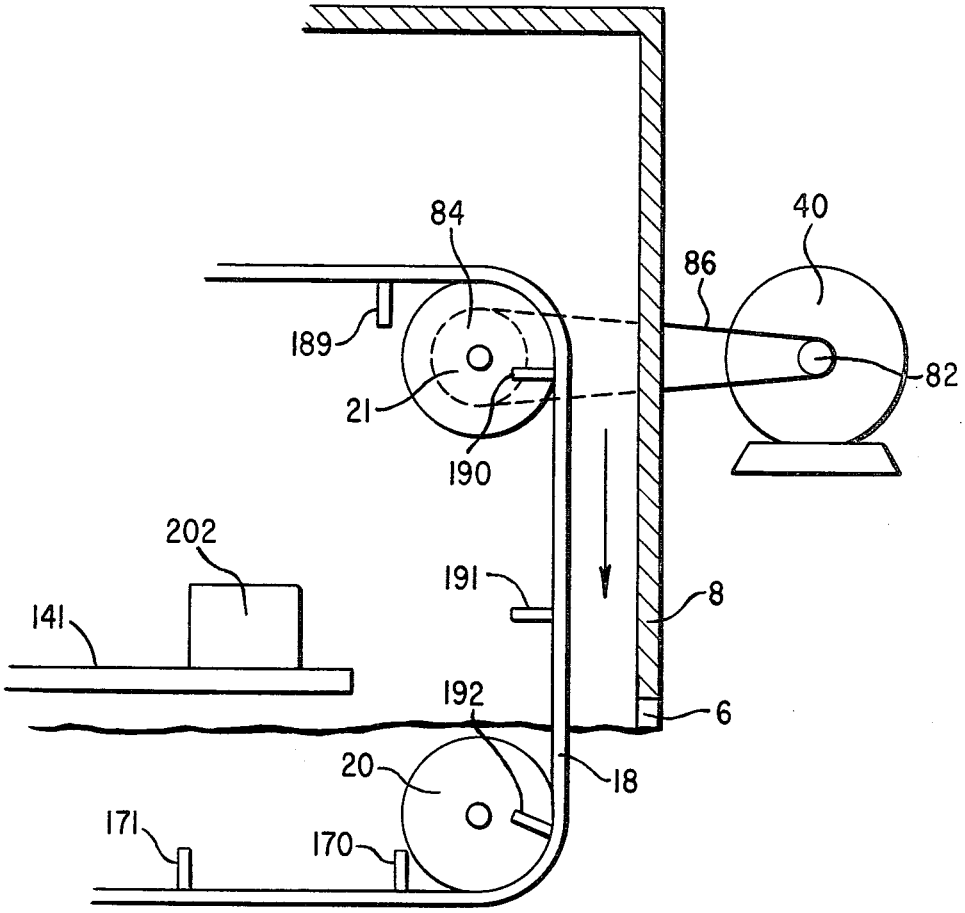

In the accompanying drawings which illustrate, by way of example, embodiments of the present invention, FIG. 1 is a diagrammatic side view of an apparatus embodying the new process revealed here, FIG. 2 is a graph showing experimental results obtained with the apparatus shown in FIG. 1 while sorting acrylic particles from said grains, and FIG. 3 is a detailed view of a portion of an alternative embodiment of the apparatus shown in FIG. 1.

Referring to FIG. 1, there is shown a fluidized particulate material sorting apparatus, comprising:

(a) a particulate material fluidizing container 1 which is elongated in a horizontal direction and has a grounded, conducting base 2 which is gas permeable over substantially the whole area thereof, at least a major intermediate lengthwise extending portion D of the interior thereof above the gas permeable base 2 being unobstructed by the container for the flow of fluidized particulate material therealong, the container having an upper gas outlet 4, (b) means 5 for feeding particulate material to the container 1, (c) means in the form of a first outlet 6 and a chute 56 for removing particulate material from a first end 8 of the container 1, (d) means in the form of a second outlet 10 and a chute 60 for removing particulate material from a second, end 12 of the container 1, (e) means generally designated 14 for feeding pressurized gas to substantially the whole area of the underside 16 of the base 2, (f) drive means including:

(i) an endless flexible member in the form of a chain 18, (ii) mounting means, in the form of sprockets 20 to 23 around which the chain 18 forming the endless flexible member is looped adjacent to each end 8 and 12 of the container with at least a lower side of the loop extending only along the said at least major, intermediate lengthwise extending portion of the interior of the container 1 for movement therealong, (iii) a plurality (in this embodiment twenty-three) of paddles 170 to 192 extending across at least the said at least major, intermediate lengthwise extending portion of the container interior and facing the first and second ends 8 and 12 respectively and distributed along the length of the chain 18 forming the endless flexible member and attached thereto so that, in operation, the paddles 170 to 192 along at least one side 38 of the loop will be at least partially immersed in a fluidized bed in the container 1, and (iv) driving means in the form of an electric motor 40 for driving the chain 18 forming the endless flexible member around the sprockets 20 to 23 forming the mounting means in a direction Z to move the paddles 170 to 192 along the container 1 at a speed, (g) a pair of electrodes including:

(i) an essentially planar electrode 141 mounted horizontally along the upper surface of the fluidized material or slightly above the surface thereof, and (ii) means 145 for electrically grounding the porous conductive base 2, and (h) a high voltage power supply 142 electrically connected by means of cable 143 to electrode 141 and passing through insulating bushing 144.

In operation, the drive means generate a recirculatory motion whereby an upper portion of the fluidized bed is moved towards the first end 8 while a lower portion is moved toward the second end 12.

A progressive enrichment of the fluidized bed in tribo-electrically charged particles of one polarity occurs towards the first end 8 with reflux of particles therefrom, and a progressive enrichment of the fluidized bed in particles of opposite polarity occurs towards the second end 12 with reflux of particles therefrom.

The gas permeable base 2 is false bottom in the container 1 and is spaced from a real bottom 42 by baffles 44 to 48 which divide the space between the gas permeable base 2 and the real bottom 42 into windboxes 50 to 55. The first outlet 6 has the chute 56 for conveying particulate material therefrom to a container 58. The second outlet 10 has the chute 60 for removing particulate material therefrom to, e.g. electromechanical conveyor 196.

The means 14 for feeding pressurized gas to substantially the whole area of the underside 16 of the base 2 comprises an air pump 64, main pipe 66 and branch pipes 68 to 73, which contain valves 74 to 79 respectively, for delivering pressurized air to the windboxes 50 to 55 respectively.

The electric motor 40 is coupled to the sprocket 21 by means of sprockets 82 and 84 and a chain 86.

The electrode 141 extends over a major portion of the width of fluidized container 1, and it is preferably constructed on an open lattice principle, such as from a coarse mesh, or from pipes or rods held together by a frame or welded to each other. Sharp corners or edges should be avoided, since these can lead to formation of corona, which is detrimental to the efficient operation of the device. If electrode 141 is maintained close to the upper surface of the fluidized bed 42 the motion of particles at the surface of the bed, especially the bursting of bubbles, will assist in preventing adherence of charged particles to the electrode. Additional means for preventing such adherence may in some cases be desirable. In the embodiment shown, the electrode 141 is grounded on a cyclical basis by means of a timed switching device 146. Alternatively, the polarity of the electrode may be reversed during periodic, short intervals through a timed switching device which disconnects the source 142 and connects a second high voltage power supply of opposite polarity to power supply 142. As a further alternative, mechanical vibrators could be attached to the electrode 141, such as 202 shown in FIG. 3.

The fluidized container 1 may be constructed from an insulating material, but this is not necessary if the width of container 1 permits an appropriate gap to occur between the long edges of electrode 141 and the vertical side walls of container 1.

In operation the container 1 is loaded with particulate material 92 and the air pump 64 is actuated so that the container 1 is filled with fluidized particulate material to the level 94.

The electric motor 40 is started to move the paddles 170 to 192 in the direction Z and the valves 74 to 79 are used to adjust the air supply to the windboxes 50 to 55 so that the particulate material in the container 1 is more or less evenly fluidized therealong. The particulate material is fed continuously to container 1 through chute 5. Electrode 141 is energized to a high potential of a selected polarity. In general, it is found that a horizontal concentration gradient will develop even in the absence of an applied potential, and that the extent of separation of the constituents of the mixture will be increased by a voltage of one polarity on electrode 141, and decreased by voltage of an opposite polarity. The polarity of the tribo-electric charge will depend on the constituents of the mixture and therefore the polarity of the electrode 141 is chosen to be opposite to the polarity acquired by the material of lower density.

A vertical gradient of horizontal velocity is developed in the fluidized particulate material in the container 1. An upper portion of the fluidized bed is moved by the paddles 170 to 192 in the direction Z to cause a progressive enrichment of the fluidized bed of particles charged to one polarity towards the first end 8 which eventually flows out of the first outlet 6. A lower portion of the fluidized bed is moved to cause a progressive enrichment of the fluidized bed in particles having charges of opposite sign in the opposite direction to the direction Z, towards the second end 12 and flow out of the second outlet 10. Thus the particulate material is sorted so that a large proportion of particles of one charge polarity in the fluidized bed flow out of the first outlet 6 and are collected in the container 58 while a large proportion of the particles of opposite charge polarity in the fluidized bed flow out of the second outlet 10 and are directed to feeder 196.

It will be appreciated that the particulate material feed flow from chute 5 is made about the same as the sum of the discharges out of the first and second outlets 6 and 10 respectively.

One embodiment of the apparatus utilized a container 1 3.66 m long by 178 mm wide by 710 mm high and a depth of fluidized bed of approximately 100 mm. The width of the paddles 170 to 192 was 178 mm, and their vertical dimension equalled 38 mm.

During operation of the apparatus a vertical gradient of horizontal velocity was developed in the fluidized particles by the paddles 170 to 192. The lower portions of the fluidized bed were caused to move parallel to the lower set of paddles 170 to 178, and the return, opposite flow in the upper part of the fluidized bed was facilitated by raising the end of the container 1 to which the paddles moved by a small angle $\alpha$, by means of wedge 200. The paddles moved the lower part of the fluidized bed from right to left, whereas the upper portions of the fluidized bed moved by gravity from left to right down the slight incline. In this manner, counter-current movement of upper and lower phases was established, while at the same time continuous interchange of material took place in a vertical direction throughout the fluidized bed. While fluidizing, the apparatus operated without feed or product removal, thus it operated at total reflux.

The separation of sand and acrylic plastic particles was studied under a variety of operating conditions. FIG. 2 shows typical results for a mixture containing 2.0% by weight of acrylic particles in sand. The enrichment ratio is defined as the ratio of the concentration of plastic particles at the plastic-rich end of the device, to the concentration of plastic particles at the plastic deficient end of the device. FIG. 2 shows that the separation efficiency of the device is influenced by the sign and magnitude of the impressed voltage on the electrode, and that by selecting an appropriate voltage and polarity a better separation can be achieved than is attainable without the use of electrostatics.

During fluidization, the acrylic particles acquired a positive charge and were therefore attracted to electrode with a negative charge. When the electrode 141 was at a negative potential the separation of the acrylic was enhanced whereas with the electrode 41 at a positive potential, the electrostatic field was working against the separation derived from the density difference combined with recirculation of the particulate material.

The decline in enrichment ratio may be attributed to corona on the electrode since the experimental results were obtained using a grid made of square section bars. The electrode should therefore either be designed to prevent corona discharge or a potential difference below the inception of corona used. FIG. 2 also indicates the benefits obtained by applying the potential across the bed of material. It can be seen from FIG. 2 that without an applied potential (i.e. at OKV) an enrichment ratio of approximately 13 was achieved by fluidization and recirculation of the material. However, upon application of the potential the enrichment radio rose to a maximum of approximately 32 before inception of corona on the electrode.

In other embodiments, other means for removing the particulates from the ends of fluidized container 1 than those shown in FIG. 1 may be used. These may include augers, bucket elevators, star valves or combinations of any of these with or without weirs.

What we claim as our invention is:

1. A method of sorting fluidized particulate material which comprises:

(a) feeding particulate material to an elongated horizontally extending container having a gas permeable base and at least a major, intermediate lengthwise extending portion of the interior thereof unobstructed by the container for the flow of particulate material towards both a first end and a second end thereof for fluidized material above the gas permeable base.

(b) fluidizing a bed of the particulate material in the container, and thereby tribo-electrically charging particles in said bed, (c) generating a vertical electrostatic field across said bed between a pair of vertically spaced electrodes to attract in the upper strata of the bed particles whose tribo charges are opposite in polarity to the upper of said electrodes, and cause an enrichment of such particles in an upper portion of the bed, (d) generating a recirculatory motion of particles in said bed so that an upper portion of the fluidized bed is moved towards a first end while a lower portion of the fluidized bed is moved towards a second end thereby causing a progressing enrichment of the fluidized bed in particles which are tribocharged to a polarity opposite to the polarity of said electrode towards the first end with reflux of particles therefrom, and a progressive enrichment of the fluidized bed in particles of opposite polarity towards the second end, with reflux of particles therefrom.

(e) removing the particulate material from the first end, and (f) removing particulate material from the second end.

2. The method as claimed in claim 1 including the step of periodically interrupting the generation of said electrostatic held to remove particulate material attached to said horizontal electrode.

3. The method as claimed in claim 1 including the step of vibrating said horizontal electrode to remove particulate material.

4. A fluidized particulate material sorting apparatus, comprising:

(a) a particulate material fluidizing container which is elongated in a horizontal direction and has a base which is gas permeable over substantially the whole area for fluidized particulate material above the gas permeable base, at least a major, intermediate lengthwise extending portion of the interior being unobstructed by the container for the flow of fluidized particulate material therealong, said container having an upper gas outlet, (b) means for feeding particulate material to the container, (c) means for removing particulate material from a first end of the container, (d) means for removing particulate material from a second, end of the container opposite said first end, (e) means for feeding pressurized gas to substantially the whole area of the underside of the base, (f) drive means within said container and operable to generate a recirculatory motion of particles in said bed so that an upper portion of the fluidized bed is moved toward said first end while a lower portion of the fluidized bed is moved toward said second end.

(g) a pair of spaced electrodes, lying generally parallel to said base and connectible to means to generate a potential difference across said electrodes, whereby in operation, the recirculatory motion of particulate material and the potential difference across said electrodes causes a progressive enrichment of the fluidized bed in particles which are tribocharged to one polarity towards the first end, with reflux of particles therefrom, and a progressive enrichment of the fluidized bed in particles of opposite polarity towards the second end, with reflux of particles therefrom.

5. Material sorting apparatus according to claim 4 wherein said drive means includes an endless flexible member entrained in a loop around mounting means with at least a lower side of the loop extending along the said at least major intermediate lengthwise extending portion of the container interior for movement therealong, a plurality of paddles extending across at least a major portion of the container interior and facing said first and second ends and distributed along the length of the endless flexible member and attached thereto so that, in operation, the paddles along at least one side of the loop will be at least partially immersed in a fluidized bed and running in close proximity to the porous base of the container, and driving means for driving the endless flexible member around the mounting means.

6. A material sorting apparatus according to claim 5 in which said endless flexible member is a chain and said mounting means include sprockets drivingly engaging said chain.

7. A material sorting apparatus according to claim 4 wherein said horizontal electrode is formed from a grid of bars.

8. A material sorting apparatus according to claim 4 wherein control means are provided for intermittently interrupting said electrostatic field to prevent accumulation of particulate material thereon.

9. A material sorting apparatus according to claim 8 wherein said control means includes a switching device to connect said horizontal electrode to a source having a polarity the same as the polarity of the other electrode.

10. A material sorting apparatus according to claim 9 wherein said other electrode is said base of said container.

11. A material sorting apparatus according to claim 8 wherein said control means includes switching means to connect said horizontal electrode to a source of opposite polarity.

12. A material sorting apparatus according to claim 4 wherein a vibrator is connected to said grid to induce vibration thereof.

* * * * *